United States Patent [19]

Myers

[11] 4,346,829

[45] Aug. 31, 1982

[54] ROLL DISPENSER CARTON

[75] Inventor: Daniel J. Myers, Cincinnati, Ohio

[73] Assignee: The Nivison-Weiskopf Co., Cincinnati, Ohio

[21] Appl. No.: 183,154

[22] Filed: Sep. 2, 1980

[51] Int. Cl.[3] ..... B26D 1/02

[52] U.S. Cl. ..... 225/48; 225/25; 225/80; 225/90; 225/91

[58] Field of Search ..... 225/48, 49, 50, 91, 225/92, 21, 90, 80, 25

[56] References Cited

U.S. PATENT DOCUMENTS

| | | | |
|---|---|---|---|
| 1,915,736 | 6/1933 | Harlbut . | |
| 2,766,877 | 10/1956 | Burbank . | |
| 2,771,185 | 11/1956 | Annen . | |
| 2,771,186 | 11/1956 | Burbank . | |
| 2,820,281 | 1/1958 | Amsen . | |
| 2,888,180 | 5/1959 | Kinker, Jr. . | |
| 3,137,424 | 6/1964 | Finn et al. | 225/49 X |
| 3,144,970 | 8/1964 | Beschmann . | |
| 3,227,340 | 1/1966 | Haley | 225/48 X |
| 3,281,036 | 10/1966 | Woodling . | |
| 3,567,087 | 3/1971 | Schramm . | |
| 3,810,567 | 5/1974 | Malcolm | 225/91 X |
| 4,005,809 | 2/1977 | Finn | 225/49 |

*Primary Examiner*—Frank T. Yost

*Attorney, Agent, or Firm*—Wood, Herron & Evans

[57] ABSTRACT

A roll dispenser carbon for dispensing sheet material, e.g., food wrap type sheet material. A unique cutting edge structure on the carton permits tearing off a length of the sheet material after that length has been withdrawn from the roll inside the carton. In the case of certain type sheet materials, the cutting edge structure retains the remaining free edge of the sheet material on the cutting edge after the desired sheet length has been torn from the roll. The cutting edge structure is comprised of a series of punched buds, each bud having at least two petals, that are formed in a metal sheet by punching that sheet with a piercing punch.

11 Claims, 5 Drawing Figures

ROLL DISPENSER CARTON

This invention relates to dispenser cartons. More particularly, this invention relates to a dispenser carton having a novel and unique cutting edge mounted on that carton.

Dispenser cartons for sheet material are, of course, very well known to the prior art. One very wide spread use for such dispenser cartons is in the marketing of food wrap type sheet material. This sheet material is commonly used for protecting food stuffs and the like. Typically, food wrap sheet material is sold in roll form, the roll being positioned in a dispenser carton that is sealed during distribution of the product from manufacturer to user. The dispenser carton also incorporates a tearing or cutting edge in the carton structure. In use, and as a user withdraws a desired length of sheet material from the carton, the sheet is positioned to overlie the carton's cutting edge. The sheet is then torn from one edge of the sheet to the other through use of that cutting edge from the continuous length left on the roll. Typical of such food wrap sheet materials marketed through use of roll dispenser cartons are polymeric films which include, for example, polyethylene film, and films produced from copolymers of vinylidine chloride and vinyl chloride. The dispenser carton, and cutting edge structure, of this invention are particularly useful with films of the lattertype.

It is very well known to the prior art to incorporate a cutting or tearing edge structure with a roll dispenser carton. Perhaps the most widely used structure to date from a commercial standpoint makes use of a separate metal blade having a serrated edge along one edge of that blade from one end to the other. The serrated blade is attached to a paperboard dispenser carton at, for example, a corner of the carton. The blade is positioned parallel to the roll's axis so that the serrated edge extends lightly beyond that corner. This permits the carton's user to easily tear a length of sheet material along the serrated edge at the desired length after drawing it off the roll from within the carton. However, this metal serrated blade has a significant disadvantage from a commercial use standpoint particularly in connection with polymeric films.

It is often the case that, after a desired length of polymeric film has been torn from a roll by the carton's cutting edge, the leading edge section of the film sheet that remains on the roll tends to retract into the carton. Accordingly, and when it became necessary to withdraw additional film from the roll by tearing a subsequent desired length therefrom, it is necessary to open the carton, locate the leading edge of the film on the roll, and thereafter separate the leading edge from that roll. This procedure is particularly troublesome when the dispenser carton holds polymeric films comprised of a copolymer of vinylidine chloride and vinyl chloride. Upon retraction into the carton, the leading or free edge of this type film's rolled up sheet tend to cling to the supply roll remaining in the carton, thereby making the location of that leading edge, as well as the separation thereof from the supply roll, relatively difficult when a subsequent sheet length is desired. A typical prior art disclosure of a roll dispenser carton for polymeric film, where the carton incorporates a metal serrated cutting edge at one corner of the carton, is illustrated in U.S. Pat. No. 3,144,970, that patent being assigned to the assignee of this application.

In recent years, there have been attempts to develop roll dispenser cartons for the marketplace that incorporate structures by which the film sheet return problem is solved. Some of these dispenser carton structures have been particularly directed to polymeric films. Each of these carton structures incorporates, of course, a tearing or cutting edge at one corner of the carton. One such type of carton structure, for example, incorporates a tacky substance coated onto one wall of the carton in proximity to the carton's cutting edge. The function of this tacky substance is to cause the leading edge of the film sheet remaining on the roll to adhere to the carton's wall adjacent the cutting edge after a desired length has been torn from the roll. This, of course, makes the free edge of the film sheet left on the roll easily accessible to the user when it is subsequently desired to withdraw another length of sheet material from the roll. Typical of prior art carton structures which incorporate a tacky coating are those illustrated in U.S. Pat. Nos. 3,549,066 and 3,974,947.

Accordingly, it has been one objective of this invention to provide an improved roll dispenser carton having a novel cutting edge structure, that cutting edge being structured to permit tearing of sheet material thereon from one side edge of the sheet to the other, as well as, in the case of certain polymeric films, to cause the free end of the sheet material remaining within the carton to be at least partially retained on, i.e., attached to, that cutting edge after the withdrawn sheet material has been torn therefrom.

It has been another objective of this invention to provide a novel and improved cutting edge structure connectable to a dispenser carton, that cutting edge structure being comprised of a series of buds aligned on a phantom center line generally parallel to the longitudinal axis of the carton, each of those buds comprising at least two outwardly extending petals disposed around a center axis oriented generally perpendicular to the carton's longitudinal axis.

In accord with these objectives, the novel dispenser carton incorporates a unique cutting edge that permits tearing off a length of the sheet material after that length has been withdrawn from the roll inside the carton. In the case of certain type sheet materials, the cutting edge structure remains at least part of the remaining free edge of the sheet material on that structure after the desired sheet length has been torn from the roll. The cutting edge structure is comprised of a series of punched buds, each bud having at least two petals, that are formed in a metal sheet by punching that sheet with a piercing punch.

Other objectives and advantages of this invention will be more apparent from the following detailed description taken in conjunction with the drawings in which.

Figure 1:
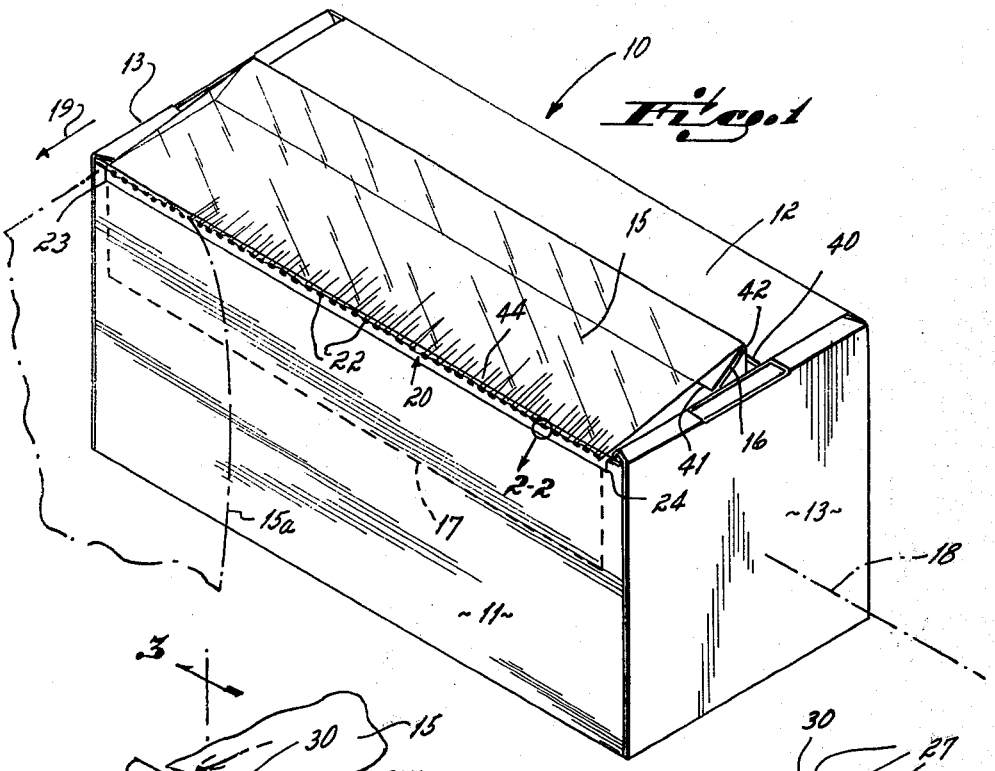
FIG. 1 illustrates a roll dispenser carton for food wrap type sheet material that incorporates a novel cutting edge in accord with the principles of this invention.

A roll dispenser carton 10 in accord with the principles of this invention is preferably formed from paperboard. The roll dispenser carton 10 includes a front panel 11, a rear panel (not shown), a floor panel (not shown), and a cover panel 12. The dispenser carton 10 also includes end wall panels 13, those end wall panels having various flaps (not shown) adapted to cooperate with the core (not shown) of a roll (not shown) of sheet material 15 for supporting the roll in rotational fashion within the carton. The cover panel 12 of the carton 10 includes a spacer flap 16 and a tuck flap 17, the tuck flap maintaining the cover panel in closed relation with the rest of the carton, and the spacer flap functioning to cooperate with the sheet material 15 as it is withdrawn in a manner described in detail below. A carton 10 of this general structure is more particularly illustrated in Beschmann U.S. Pat. No. 3,144,970, assigned to the assignee of this application, the carton structure shown in that patent being incorporated herein by reference. The roll dispenser carton 10 of this invention also incorporates novel cutting edge 20.

The carton's cutting edge 20, prior to installation on the carton, is comprised of a strip 21 of relatively thin bendable and flexible metal which is provided with at least one row of buds 22 there along from one end 23 to the other 24. This row of buds lies on a linear phantom center line 25, that center line 25 being parallel to the carton's longitudinal axis 18. The carton's longitudinal axis 18 is generally and approximately coaxial with the rotational axis of the roll of sheet material 15 stored therein. In other words, the center line 25 of buds 22 is perpendicular to the discharge direction 19 of the sheet material 15 as it is withdrawn from the roll within the carton 10.

Each bud 22 is comprised of at least two petals 27 with at least one petal being located on each side of the bud row center line 25. The petals 27 of each bud 22 are connected along fold lines 29 with the base strip 21, and are generally pointed at their outer ends as at 30. Note particularly, the plural petals 27 of each bud 22 are disposed about a bud axis 31 generally perpendicular to the plane 32 of the metal strip 21 in the as fabricated condition prior to installation, see FIG. 5. Note further that the bud's axes 31 are located in the plane 33 of the carton panel 11 to which the strip 21 is connected in the installed condition, see FIG. 3. As illustrated particularly in FIGS. 3 and 5, the plural petals 27 of each bud 22 are configured in an outwardly flaring direction relative to the center axes 31 of the buds. It is to be understood that the number of petals 27 per bud 22 may be varied as desired, and that it also may be desired to provide a greater or lesser number of petals in some buds than in other buds along the length of the cutting edge 20, in order to vary the coarseness of the cutting edge. Further, coarseness of the cutting edge 20 may be varied by varying the length of the petals 27 in each bud 22, and by varying the sharpness of the points 30 defined by the petals of each bud.

Figure 4:
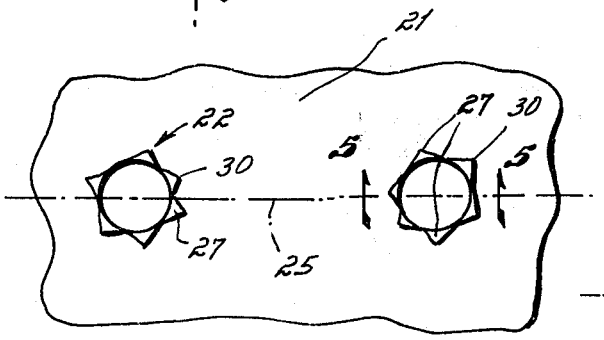
FIG. 4 is a top view of a section of the cutting edge structure shown in FIG. 1, but prior to that edge structure being installed on the dispenser carton.
Figure 5:
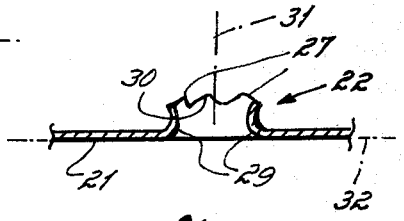
FIG. 5 is a cross sectional view taken along line 5—5 of FIG. 4.

The aligned buds 22 of the cutting edge 20 may be provided in the base strip 21, when that strip is planar as shown in FIGS. 4 and 5, by punching that strip with a piercing punch and die that will cause displacement into the groups of plural petals 27 earlier described. It is particularly desirable for the cutting edge 20, shown in combination with the dispenser carton 10 of FIG. 1, that the metal base strip 21 from which the buds 22 are formed be sufficiently bendable and flexible so that it may be folded substantially 180° along the center line or fold line that generally coincides with the phantom center line 25 on which the buds are positioned. This will permit the bendable strip 21 to be folded over or around an exposed lip 14 of the carton's front panel 11 for the purpose of joining the cutting edge 20 to that front panel along the front/cover panel corner edge of the carton 10. Of course, the metal base strip 21 used also must be of those bendable and flexible characteristics which will provide the desired stiffness of the plural petals 27 for each punched bud 22 during use as a cutting edge.

Figure 2:
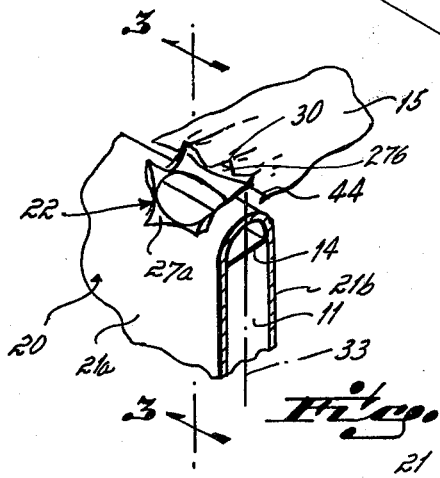
FIG. 2 is an enlarged fragmentary view of the circled area 2—2 of the cutting edge shown in FIG. 1.
Figure 3:
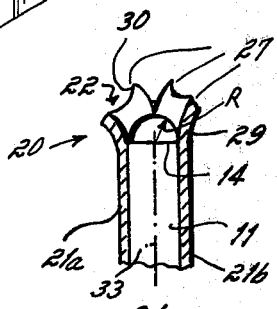
FIG. 3 is a cross sectional view taken along line 3—3 of FIG. 2.

With the base strip 21 and buds 22 forms as illustrated in FIGS. 4 and 5, the strip is thereafter installed on the dispenser carton along edge 14 of the carton's front panel 11. Installation is achieved, as illustrated in FIGS. 2 and 3, by folding one side **21*a* of the strip into substantially 180° or parallel relation with the other side 21*b* of the strip along a fold line that is coaxial with the phantom center line 25 of the buds 22 formed on the strip. This folding step thereby entraps free edge 14 of the front panel 11 between the opposed sides 21*a*, 21*b* of the folded strip and, with the strip installed on that wall panel's free edge, orients axes 31 of the cutting edge's buds in the plane 33 of that front panel. The side 21*a*, 21*b* areas of the strip 21 are thereafter crimped into attached relation with the front panel's leading edge 14 so as to retain the cutting edge 20 on the front panel 11. When so installed, and as shown in FIGS. 2 and 3, the buds' petals 27 are positioned over a radius R at the carton's cutting edge 20**.

Use of the dispenser carton 10, with the cutting edge 20 structure of this invention installed thereon, is illustrated in FIG. 1. As shown in that figure, a desired length of the sheet material is withdrawn in the withdrawal direction 19 from roll through elongated slot 40 in the cover panel 12 of that dispenser carton. Spacer flap 16 of the cover panel 12 tends to flex forward on fold line 41 as the sheet material is withdrawn, the film or sheet thereby tending to bridge a gap between edge 42 of the spacer flap and the novel cutting edge 20 structure attached to the carton's front/cover panel corner when the sheet is positioned to overlie the cutting edge 20 in preliminary tearing position. With the desired length so withdrawn, that length is torn off the film remaining on the roll inside the carton. The tearing is accomplished, in the usual fashion, by drawing the one sheet edge **15*a* of the desired length downwardly starting from cutting edge end 24 toward cutting edge end 23** until the entire desired sheet length is torn off the material remaining on the roll.

When a polymeric film comprised of a copolymer of vinylidine chloride and vinyl chloride is the sheet material 15, as the film sheet is torn across the cutting edge 20 at least part of the free edge 44 of the sheet material 15 remaining on the roll tends to remain connected to, i.e., to be gripped or retained by, the cutting edge 20 structure because of the unique plural pointed petal 27 configuration of the multiple buds 22 that make up that cutting edge, all is illustrated in FIG. 1. This, of course, makes it quite easy for a subsequent user of the carton to grasp the free edge 44 of the sheet 15 retained on the cutting edge 20, and to simply lift that free edge off the cutting edge 20, prior to withdrawing a second and subsequent desired length from the roll remaining with the carton 10. Thus, the cutting edge 20 structure on the roll dispenser carton 10 of this invention functions not only as a cutting edge by which a desired length of polymer film may be torn from the length remaining on the roll within the carton, but also functions to retain the free edge 44 of the length remaining on the roll so that free edge does not tend to retract into the carton and rewrap itself on the roll. This latter function of the cutting edge 20 structure is due to the mechanical interengagement of the cutting edge's plural pointed buds 22 with the sheet material 15. In other words, these functions are accomplished because, in the case of at least some buds 22, leading petal 27*a* of the bud tends to act as the tearing petal for the polymer film and trailing petal 27*b* of the bud tends to act as the grabbing petal to snare and retain the polymer film on the cutting edge 20, all as shown in FIGS. 1 and 2.

Having described in detail the preferred embodiment of my invention, what I desire to claim and protect by Letters Patent is:

1. A roll dispenser carton comprising at least three panels joined one to the other in carton configuration, said carton being sized to receive a roll of sheet material therein, and said sheet material being withdrawable from said carton in a discharge direction, and a cutting edge structure connected to at least one panel of said carton, said cutting edge structure comprising a series of buds extending outwardly from said panel, each of said buds comprising at least leading and trailing petals adapted to engage sheet material unwrapped from said roll for tearing a desired length of sheet material off said roll, said plural buds being positioned along at least one phantom line disposed generally perpendicular to the discharge direction of said sheet material from said carton, at least some of said leading petals cooperating to permit tearing of said desired sheet length from said roll and at least some of said trailing petals cooperating to cause the free end of sheet material still wrapped on said roll to remain attached to said cutting edge structure after said desired length is torn off when said sheet material is one of a polyethylene film and a film produced from a copolymer of vinylidine chloride and vinyl chloride.

2. A carton as set forth in claim 1, said cutting edge structure further comprising a base strip, said buds being defined from said base strip, said base strip being folded along a line generally the same as said phantom bud line, and said base strip being attached to an edge on one of said panels so that opposite sides of said base strip are folded in overlapping relation with one another with said carton edge being trapped therebetween, thereby positioning at least some of said buds' petals over a radius at said carton's cutting edge.

3. A carton as set forth in claim 2, said cutting edge structure being attached to one corner of said carton.

4. A carton as set forth in claim 2, each of said buds defining an axis about which said petals are positioned, the axes of at least some of said buds being oriented generally in the plane defined by that carton panel to which said base strip is connected.

5. A carton as set forth in claim 1, at least some petals of at least some buds being flared outwardly relative to the axis of those buds, each of said buds defining an axis about which said petals are positioned, and the axes of at least some of said buds being oriented generally normal to the discharge direction of said sheet material.

6. A roll dispenser carton comprising at least three panels joined one to the other in carton configuration, said carton being sized to receive a roll of sheet material therein, and said sheet material being withdrawable from said carton in a discharge direction, and a cutting edge structure connected to at least one panel of said carton, said cutting edge structure defining a cutting edge, said cutting edge structure comprising a series of buds extending outwardly from said panel along the length of said cutting edge, each of said buds comprising at least two petals adapted to engage sheet material unwrapped from said roll for tearing a desired length of sheet material off said roll, and a base strip from which each of said buds is defined, said base strip being folded along a line generally the same as said cutting edge for connecting said strip to said carton, at least some of said buds being positioned on a radius relative to said cutting edge when said strip is connected to said carton, those buds so positioned on said radius having at least one leading petal and at least one trailing petal relative to the discharge direction of said sheet material.

7. A carton as set forth in claim 6, said base strip being attached to an edge on one of said panels, opposite sides of said base strip being folded in overlapping relation with one another with said carton edge being trapped therebetween.

8. A carton as set forth in claim 6, said petals of each bud being disposed about an axis, at least some petals of at least some buds being flared outwardly relative to the axis of those buds.

9. A carton as set forth in claim 6, said petals of each bud being disposed about an axis, the axes of at least some of said buds being oriented generally normal to the discharge direction of said sheet material.

10. A carton as set forth in claim 6, said petals of each bud being disposed about an axis, the axes of at least some of said buds being oriented generally in the plane defined by that carton panel to which said base strip is connected.

11. A carton as set forth in claim 6, said plural buds being adapted to snare at least part of the free edge of certain types of sheet material which remain on said roll after a desired length of said sheet material has been torn off said roll, thereby causing at least part of said sheet material's free edge to remain attached to said cutting edge structure.

* * * * *